US005236813A

United States Patent [19]

Caldwell, deceased et al.

[11] Patent Number: 5,236,813

[45] Date of Patent: Aug. 17, 1993

[54] DRY PROCESSABLE COPPER HALIDE PHOTOSENSITIVE SYSTEM

[75] Inventors: Ray S. Caldwell, deceased, late of Denver; by Ester C. Caldwell, Executor, Arvada, both of Colo.

[73] Assignee: Action Exploration Services, Denver, Colo.

[21] Appl. No.: 873,943

[22] Filed: Apr. 17, 1992

[51] Int. Cl.[5] ..... G03C 5/56

[52] U.S. Cl. ..... 430/346; 430/495

[58] Field of Search ..... 430/346, 495, 943, 616, 430/394, 494

[56] References Cited

U.S. PATENT DOCUMENTS

| | | | |
|---|---|---|---|
| 4,427,762 | 1/1984 | Takahashi et al. | 430/436 |
| 4,433,049 | 2/1984 | Itoh et al. | 430/495 |
| 4,904,576 | 2/1990 | Caldwell | 430/495 |

FOREIGN PATENT DOCUMENTS

| | | | |
|---|---|---|---|
| 756553 | 4/1967 | Canada | 430/616 |

*Primary Examiner*—Charles L. Bowers, Jr.
*Assistant Examiner*—John A. McPherson

[57] ABSTRACT

A photosensitive element for the preparation of high quality images using an entirely dry process is provided. The photosensitive portion of this element is prepared from the anode product of an electrolysis of copper in an acid halide bath. Preferably, this material is cuprous halide. The element is then sensitized with an ascorbic acid-containing solution and given an image-wise exposure in actinic or visible light. The image is then developed by giving the element an over-all exposure to monochromatic light of about 5800 angstroms. A high quality, full dry image with good quality and shelf-life is obtained.

8 Claims, No Drawings

DRY PROCESSABLE COPPER HALIDE PHOTOSENSITIVE SYSTEM

CROSS REFERENCE TO RELATED APPLICATION

This application discloses subject matter related to that disclosed in prior U.S. patent application Ser. No. 170,289, filed Mar. 18, 1988, which issued as U. S. Pat. No. 4,904,576 on Feb. 27, 1990.

BACKGROUND OF THE INVENTION

This invention relates to photosensitive elements and particularly to photosensitive elements based on copper halides. Still more particularly, this invention relates to a method of developing copper halide photosensitive elements by light without the need for liquid processing solutions. Even more particularly, this invention relates to dry processable photosensitive copper halide elements with improved image quality and shelf-life.

In U.S. Pat. No. 4,904,576, prior art is mentioned which bears on the use of copper halide as a photosensitive media. Most of those prior art elements are believed inferior to the invention described in U.S. Pat. No. 4,904,576. Indeed, most of such prior art including U.S. Pat. No. 4,904,576 require that some sort of processing fluid be employed to get a high quality, long-lasting image from the exposed copper halide element. Thus, with today's emphasis on the environment, there is an ever-pressing need to prepare photosensitive elements that do not require processing fluids to develop the images formed thereon. There is also a need to prepare suitable images that can be dry-processed and still possess high image quality and long shelf-life.

OBJECTIVES AND SUMMARY OF THE PRESENT INVENTION

It is accordingly an object of the present invention to provide a novel photosensitive system that can be developed without the use of processing fluids.

It is yet another object of the present invention to provide a dry processable photosensitive system based on copper halide as the imaging medium and a method of developing same by light without use of processing solutions.

In accordance with the present invention, there is thus provided a photosensitive element comprising a support, a photosensitive layer coated on said support wherein said photosensitive layer comprises the copper containing anode product produced by the electrolysis of copper in an aqueous acid halide bath, wherein said copper is mixed with an aqueous solution of an oxidant and a sensitizer layer coated thereon comprising an aqueous solution of ascorbic acid or derivatives thereof.

The novel photosensitive element of the present invention can be imaged in a process wherein the aforementioned coating is given an image-wise exposure to actinic light followed by an imaging exposure to monochromatic light to develop said image formed thereon.

DETAILED DESCRIPTION OF THE INVENTION

The photosensitive material of the present invention is prepared from the anode product of an electrolysis of copper in an aqueous acid halide bath as is fully described in U.S. Pat. No. 4,904,576, herein incorporated by reference in its entirety. Previously, copper halides were thought to be only slightly light sensitive and did not produce a long-lasting image. By using the novel process described in U.S. Pat. No. 4,904,576, the sensitivity of the copper halide produced thereby is greatly enhanced and the image quality (density, etc.) and shelf-life is also greatly improved. However, in the invention disclosed in U.S. Pat. No. 4,904,576 the image formation requires an aqueous processing step. It is well-known that disposal of waste, processing fluids is becoming an environmental problem. Hence, the present invention negates the problem of waste formation by producing images that may be formed solely by application of light (i.e., in dry form) and require no processing solutions.

The production of the photosensitive cuprous halide material of this invention begins with the collection of the anode product of an electrolysis of copper. As is well known, electrolysis can be carried out over a wide range of electrical potentials and currents. For example, a 12 volt, 6 ampere bath system produces a material which is virtually the same as that produced by an otherwise analogous 36 volt, 18 ampere system. The copper source comprises the copper anode used in the electrolysis bath cell system. The halide source preferably is a halide ion source such as that provided by acids capable of producing halide ions. The electrolysis is most preferably carried out in a halide bath system provided by a dilute solution of hydrochloric or hydrobromic acid. The anode product material produced by this electrolysis includes cuprous chloride in the case of a copper electrolysis conducted in a hydrochloric acid bath system, cuprous bromide in the case of a copper electrolysis conducted in a hydrobromic acid bath, and so forth. If desired, the photosensitive anode products of the present invention can be co-prepared from combined halide ion sources such as hydrochloric acid and hydrobromic acid. The anode product material need not be, and preferably will not be "pure" cuprous chloride, "pure" cuprous bromide etc., but rather should be a mixture of cuprous halide and other materials and/or a more complex molecule, having other attributes such as those associated with cuprous oxyhalides. The same is also true of any other cuprous halide products which can be employed, e.g., cuprous chlorobromide, cuprous iodobromide, cuprous chloroiodobromide, etc.

For example, a typical cuprous chloride material prepared by the electrolysis of copper is not "pure" cuprous chloride, but rather contains, by weight, 60.18% copper, 33.18% chlorine, 4.88% oxygen, and 1.13% hydrogen. The resulting cuprous chloride anode product material is formed as particles having a maximum dimension which is only about 1/20 of the maximum dimension of cuprous chloride crystals produced by conventional precipitation methods. Accordingly, the maximum dimension of cuprous chloride anode product material as well as other cuprous halide anode product materials produced by an electrolysis of copper in accordance with the present invention typically will have a maximum dimension of about one micron.

The cuprous halide anode product materials produced as described above are photosensitive, i.e., they react to light by changing color, in the presence of water, or other polar substances, but are not photosensitive when they are dry. When wet, they turn from pure white to shades of gray, to deep black, in direct relation to light intensity and time of exposure, but as they dry, they revert back to the original white.

After formation of the photosensitive, anode product, copper halide material, the material is recovered and combined with and at least partially dissolved in a solvent to form a coating solution. The solvent comprises an aqueous solution of an oxidant such as hydrogen peroxide. An exemplary solvent for use in the formation of the coating solution comprises a mixture of acetone, water, and 3% hydrogen peroxide, in a volume ratio of 2:6:1, respectively. The pH of the solvent is adjusted to between about 1–2 by addition of a suitable acid such as sulfuric acid. The resulting slurry of the copper halide in the solvent is semi-syrupy in form and generally honey colored.

An excess of the cuprous halide is admixed with the solvent and let stand for a period of time to permit the color of the solution to change from green to blue. The pH of the solution will rise to about 5–6.

The material is not particularly light sensitive at this stage and may be handled safely in the presence of room light, for example. The material may then be coated on any of the conventional photosensitive supports such as paper, film, etc. The use of a paper support or a film support is preferred that has been previously coated with a subbing layer to permit aqueous coatings to be applied thereon. The coating is then dried with, e.g., warm air.

A preferred coating for the support may comprise, for example, a 5% solution of polyvinylalcohol.

In yet another embodiment, a binder may be added to the solution of sensitive copper anode product in lieu of or in addition to separate application to the support. This binder may be comprised of any of the well-known photosensitive binder materials such as gelatin, hydrolyzed gelatin, polyvinylalcohol, etc., with polyvinylalcohol being preferred.

A sensitizer coating comprising an aqueous solution of ascorbic acid or derivatives thereof is then applied to the dried copper-containing layer. An exemplary sensitizing layer comprises, for example, acetone, glycerol, water and ascorbic acid. A preferred sensitizer coating composition comprises 10 ml. acetone, 15 ml. glycerol, 25 ml. water and 5 gms. ascorbic acid.

The sensitizer solution during formation is stirred well until it becomes clear, indicating that all ingredients are dissolved. The pH is adjusted to 3–4 by addition of ammonium hydroxide. Sodium bicarbonate is added until all gaseous emission (believed to be $CO_2$) ceases and the solution is clear. Usually, 500 mg. of sodium bicarbonate is required for the solution exemplified above.

The resulting sensitizing solution is then applied directly to the dried, copper-containing layer. This application may be accomplished by any of the well-known techniques (e.g., wiping on or applying with some coating device such as a knife, etc.). Dropwise application followed by even spreading with a soft sponge or brush will suffice. At this point, the element becomes light sensitive and must be protected by applying the sensitizer coating in a light-free environment or in the presence of very dim light. The sensitizer coating is dried with, for example, warm air and the element stored for later use. The resulting coating is white in color and light-sensitive.

Image-wise exposure of this element to actinic or visible (white) light is accomplished in a conventional manner to produce a latent image. A very short exposure (e.g., 1–3 seconds) is usually required to produce a latent image thereon by suitable means such as through a negative. If the exposure is too long, the latent image can actually be faintly observed and the final image may have a high background density (e.g., fog). The speed and tone of exposure is proportional to light intensity.

The latent image is then developed by an over-all exposure of this element to monochromatic light, preferably deep yellow light on the order of about 5800 angstroms. This developmental exposure is usually longer than the image-wise exposure and may be as long as 15 seconds, for example. In order to insure that the light is monochromatic, a filter may be placed between the image and the light source. A suitable filter may be simply a yellow-tinted, conventional acrylic plastic about 3/16 inch thick. A suitable exposure device may be, for example, a 100 watt tungsten bulb spaced about 4 inches from the aforementioned filter. Preferably, a yellow filter manufactured by Spectrum Corp., P.O. Box 646, Woodinville, Wash. 98072 (Filter #161) is used to perform this image-forming step.

The resulting image is of extremely high quality. The density is high and the contrast excellent. The background areas remain white and free of fog and the image has an excellent shelf-life.

This invention will now be illustrated by, but not limited to, the following examples of which Example 5 is thought to represent the best mode.

EXAMPLE 1

An anode product made by the electrolysis of copper in a aqueous acid halide bath (e.g., HCl) was made according to the teachings of Example 1 of U.S. Pat. No. 4,904,576. This material is thought to be cuprous chloride and is removed from the electrolysis equipment as a fine slurry. About 4–5 gms. of this material was slurried with a solution comprised of acetone (20 ml.), distilled water (60 ml.), and 3% hydrogen peroxide (10 ml.).

The pH of this solution was adjusted to 1–2 with sulfuric acid. An excess of the copper anode product was stirred into this solution and allowed to stand for about 4 hours. During this period, the solution color changed from green to blue and the pH rose to 5–6. Hydrogen gas was evolved during this process. About 4–5 gms. of the cuprous chloride dissolved during this time.

This solution was then coated onto paper which was previously coated with a 5% solution of polyvinylalcohol to enhance the coating thereof and to act as a subbing layer. Several drops of the above solution were placed on this copper coating and spread evenly with a soft sponge or brush. This layer was then dried with warm air. Onto this dried layer was formed a sensitizer layer by application of a solution comprised of acetone (10 ml.), glycerol (15 ml.), water (25 ml.), and ascorbic acid (5 gms.).

This sensitizer solution was stirred well and a 14% solution of ammonium hydroxide added to bring the pH to 2.5. About 500 mg. of sodium bicarbonate was added and the solution stirred well to insure all evolving gas was expelled prior to coating over the copper containing layer. At this point, the element was light sensitive and had to be kept in a darkened area to prevent exposure.

To test the photosensitivity of this element, an image was laid over the dried element and exposed for 1 second to a 100 watt tungsten light bulb at a distance of about 4 inches. The exposed latent image was then developed by giving the image an over-all exposure to the same light source through a yellow-dyed acrylic plastic filter which was 3/16 inches thick and fully covered the imaged area. This filter removed all light except that emitted at about 5800 angstroms and thus the light that impinged on the exposed, photosensitive element was monochromatic in nature. A high quality, black and white image resulted. The image had excellent density, good grey tones and low fog. Additionally, this image was stable and could be kept for a long period of time.

EXAMPLE 2

The cuprous chloride dissolved in the solution of Example 1 was mixed with a polyvinylalcohol (PVA) binder to form a solution comprised of 20 ml. of the cuprous chloride solution from Example 1 and 60 ml. of 7% aqueous PVA solution.

This material had the consistency and color of honey and was coated on a paper support without further treatment (e.g., no subbing layer). A sensitizing solution which comprised an aqueous solution of sodium ascorbate (e.g., by combining sodium bicarbonate with aqueous ascorbic acid as described in Example 1) was then coated over the dried layer of cuprous chloride in PVA. The element was further dried and exposed through a negative element to white light. A latent image was produced and this image then further developed by giving this element an overall exposure to monochromatic light as described in Example 1. An excellent, high quality image was achieved.

EXAMPLE 3

Example 2 was repeated except that the overall exposure to monochromatic light was accomplished using a Corning Glass Filter No. 3-71, Corning Glass Works, Corning , N.Y. An excellent image was achieved.

EXAMPLE 4

In this example, the element of Example 2 was prepared and coated on a polyethylene terephthalate support (e.g., Mylar, E. I. du Pont de Nemours & Co., Wilmington, Del.) which had been suitably subbed to receive an aqueous coating. This element wa given an overall, monochromatic exposure through Spectrum Glass No. 161S, Corning Glass Co., Corning, N.Y. An excellent image was obtained thereon.

EXAMPLE 5

In this example, the element of Example 2 was produced but given an overall exposure to monochromatic light through a filter produced by Spectrum Corp., P.O. Box 646, Woodinville, Wash. 98072 (Filter #161). This material was 6"×6" square and ¼" thick and the pH of the sensitizer solution of Example 1 adjusted to 6.0 prior to coating. A very high quality image of exceptional stability was achieved in this example.

What is claimed is:

1. A method for producing an image without processing fluids comprising (1) providing a photosensitive element comprising a support, a photosensitive layer coated on said support wherein said photosensitive layer comprises a copper-containing anode product produced by the electrolysis of copper in an aqueous acid halide bath, said photosensitive layer being applied to said support in a solution comprising an oxidant and dried, and a sensitizing layer coated thereon comprised of an aqueous solution of ascorbic acid or derivatives thereof, and drying said coating to yield a photosensitive layer, (2) image-wise exposing said photosensitive layer with actinic or visible light to form a latent image, and (3) developing said latent image by exposing said image to monochromatic light.

2. The method of claim 1 wherein said monochromatic light is provided by light of about 5800 angstroms.

3. The method of claim 1 wherein said monochromatic light is yellow.

4. The method of claim 1 wherein said aqueous solution of ascorbic acid comprises a solution of sodium ascorbate.

5. The method of claim 1 wherein said oxidant is hydrogen peroxide.

6. The method of claim 1 wherein said copper containing anode product is cuprous chloride.

7. The method of claim 1 wherein said photosensitive layer is coated on a paper support and additionally contains a binder therein.

8. The method of claim 7 wherein said binder is polyvinylalcohol.

* * * * *